US005966877A

United States Patent [19]

Hawes

[11] Patent Number: 5,966,877

[45] Date of Patent: Oct. 19, 1999

[54] RAPIDLY DEPLOYABLE PROTECTIVE AND STRUCTURAL COVER SYSTEM

[76] Inventor: Ray Hawes, 14 Vale St., Peterborough, N.H. 03458

[21] Appl. No.: 09/075,055

[22] Filed: May 8, 1998

Related U.S. Application Data

[60] Provisional application No. 60/046,355, May 13, 1997.

[51] Int. Cl.[6] ..... E04B 1/12

[52] U.S. Cl. ..... 52/63; 52/3; 52/4; 52/5

[58] Field of Search ..... 135/96, 88.01, 135/88.07; 52/63, 3, 4, 5; 14/18, 20, 22; 442/2

[56] References Cited

U.S. PATENT DOCUMENTS

| | | | |
|---|---|---|---|
| 1,580,287 | 4/1926 | Colle | 161/49 |
| 2,545,981 | 3/1951 | Warp | 18/56 |
| 3,297,461 | 1/1967 | Siddall | 117/4 |
| 3,310,453 | 3/1967 | Lappala | 161/49 |
| 4,170,675 | 10/1979 | Greengrass | 428/109 |
| 4,416,928 | 11/1983 | Carl | 52/63 |
| 4,815,562 | 3/1989 | Denny et al. | 182/138 |
| 4,986,389 | 1/1991 | Halligan, Sr. et al. | 182/138 |

*Primary Examiner*—Carl D. Friedman
*Assistant Examiner*—Dennis L. Dorsey
*Attorney, Agent, or Firm*—George W. Dishong

[57] ABSTRACT

A rapidly deployable protective and structural cover system comprising a frame structure and at least one multilayered flexible cover which is comprised of a flexible cover sheeting and a structural netting. The flexible cover sheeting has a plurality of eyelets arranged over the surface area of the flexible cover sheeting. The cover sheeting is attached at a selected plurality of eyelets to the structural netting at the intersections of horizontal and vertical members or strands of the structural netting. The frame structure is preferably comprised of steel cables attachable at the ends thereof to a rigid support structure; turnbuckles to tension the cables. The multilayered flexible cover is removably attachable along edges of the structural netting to the frame and to the cables. There may also be at least one spring or other stretchable/elastic device attached to an edge of the structural netting and to a rigid support structure which may be a structure being covered or a rigid frame to which is attached the frame structure of the rapidly deployable cover system.

11 Claims, 3 Drawing Sheets

RAPIDLY DEPLOYABLE PROTECTIVE AND STRUCTURAL COVER SYSTEM

This application claims the benefit of U.S. Provisional Application No. 60/046,355, filed May 13, 1997.

BACKGROUND OF THE INVENTION

1. Field of the Invention

This invention most generally relates to a multilayer flexible cover made up of a flexible structural netting and a flexible sheeting attached each to the other atjunctions of the horizontal and vertical netting members. Preferably the attachment is air-tight and is undoable so that new flexible sheeting may replace damaged portions of the flexible sheeting. The multilayer flexible cover is a protective and structural cover system primarily for use in building and repair industries such as ship building and repair, bridge work, building construction or repair to a building and for use where a low-cost system of protection of a structure or space is needed and needed quickly. More particularly, the invention relates to a rapidly deployable protective and structural cover system comprising a rigid support structure which may be a part of the structure being covered or protected or may be separately fabricated and attached to the structure to which is attached the multilayer flexible cover using either rigid members or cables attachable at the ends to the rigid support structure. Where cables are used there is also a means to tension the cables such as a turnbuckle. The multilayer flexible cover is removably attachable along edges of the structural netting portion to the cables. Springs may be use for absorbingly attaching another edge of the structural netting to the rigid support structure.

2. Description of the Prior Art

Although there are various patents disclosing embodiments for easily deployable temporary covers, shields and shelters, the following patents known to the inventors hereof, do not in any manner suggest or teach the rapidly deployable Protective and Structural Cover System disclosed and claimed by applicants in the instant application for patent.

U.S. Pat. No. 5,582,266 to Rexrod et al. discloses a double layer netting system which is a safety/debris net system in which the debris net and safety net are fabricated as one unit. The netting is formed from a material which is resistant to weakening by ultraviolet radiation and therefore does not have to be chemically treated to withstand prolonged exposure to sunlight. The safety net is a "courser" netting, mostly for strength to catch large objects, such as possibly tools or people. The debris net is a much finer mesh, for smaller particles. Thus, although the '266 patent discloses a type of double netted system, there is no teaching in the '266 patent to use such a system to completely cover large objects or large areas of objects, or to protect such objects or areas from the elements.

U.S. Pat. No. 5,265,974 to Dargie discloses a safety net assembly and system for covering an opening in the ground for a subterranean work place. The system prevents a person from falling into the work area through the opening in the ground. The system comprises two rods having attaching brackets. The brackets may be engaged over ledges in a frame defining the opening to an underground work area. A net or webbing is then slidingly engaged on the rods so that the netting may be opened for access to the work area, or slid across the opening to close the opening and prevent a person from falling through the opening. The system does disclose netting which is slidable along support members and attachable to the support members by rings or clamps (see FIGS. 3 and 4). The support members are rigid rods. The system of the '974 patent does not disclose any means for using the system to cover objects, nor is there any way this system can be used to protect from the elements. There is also no means for supporting the netting of the '974 patent at any interval between the frame elements.

U.S. Pat. No. 4,986,389 to Halligan, Sr. et al. also discloses a covering for a below ground area or pit. This system has a rope edging and a guide cable around the perimeter of the pit. The guide cable provides a means by which, or along which, the netting may be slid to open and close the covering. Closable links connect the netting to the cable along three sides of the opening and snap rings attach the fourth side to the cable. The links allow the net to be opened and closed by sliding along the cable. The rings secure the net in the closed position over the pit. The cable is made taut by use of turn buckles. This system also could not be used to protect from the elements, or cover large areas or objects, and also has no additional support beyond the cable guide frame.

U.S. Pat. No. 4,875,549 to Denny et al. and related U.S. Pat. No. 4,815,562 to Denny et al. disclose a vertically—oriented debris barrier for use primarily in high-rise construction. The netting is suspended from a cable which allows the netting to be dropped from the cable. The netting is then anchored to the floor by nails or some fastener driven into the floor through conventional roofing fastener plates. The netting is attached to the cable by clips having a continuous U-shaped configuration and which are slipped through an opening in the netting. Additional sections of netting may be installed adjacent each other and attached to each other by the same type of clips. The barrier can serve as a wind break, and prevent workers and debris from falling from unfinished high-rise buildings. The system can withstand a maximum static load of 1,200 pounds. Although the netting system of the '549 and '562 patents can form a walled structure, there is no support for the central portion of the netting beyond the frame and the floor anchors, and there is no teaching of adding any type of overhead roof structure to protect the construction area from the elements.

U.S. Pat. No. 4,008,730 to Keklak et al. discloses an aircraft shelter and rigging to protect a small aircraft from the elements. The structure is light-weight and portable and comprises fixed upright tail and wing tip posts, and a light weight generally horizontal boom forward of the tail post bisecting a line between the wing tip posts. A series of cross arms extend to form a structural frame. The structure frame is rigged with rope and fabric is cut, sewn and laced on the rope and forms the shape of a small aircraft. The covering is thus suspended above and aircraft. The fabric covering is fixed in place on the rope structure supported by the booms and cross arms. Although the '730 patent system is intended to protect the aircraft from the elements, and comprises a roof type structure, there is no teaching of providing any wall type structures for completely protecting the aircraft, or workers working on the aircraft.

U.S. Pat. No. 5,613,543 to Walton issued Mar. 25, 1997 discloses a temporary protective covering system which provides supports covered by fabric or plastic panels and which can be easily installed and removed. Although the system provides continuous protective covering over an area, structure or object, the patent does not teach two layers of support or covering on the frame wherein the outer covering may be removed, in case of damage for example, while retaining the frame and support layers.

U.S. Pat. No. 5,555,681 to Cawthon issued Sep. 17, 1996 discloses a modular building system comprising framing elements and a flexible wall or roof panel wherein the frame elements are formed preferably from a plastic, and the flexible sheet covering formed preferably from woven or non-woven material, plastic, or metal screen. This patent also makes no mention of a multi-layer structure. The '681 patent is directed mainly towards structures such as yard storage sheds, greenhouses, gazebos and sun rooms. The patent does not teach using such a system for enclosing construction or repair sites on structures or objects such as buildings, bridges, or ships.

U.S. Pat. No. 5,487,402 issued Jan. 30, 1996 to Clary discloses a portable shelter having an expandable frame. The framing element can be made of differing size and a shelter skin is then applied over the frame. This abstract does not mention a multi-layer covering. The patent does not specifically address creating a sealed enclosure to completely protect a large object or area from the elements, and in which a controlled environment may be maintained.

U.S. Pat. No. 4,102,353 issued Jul. 25, 1978 to Pugliese discloses a temporary shelter which is portable yet attachable to a permanent shelter. The shelter has side and cross bars attachable to a permanent structure, over which are placed side panels. This patent also makes no mention of multiple layers or any way to distribute stresses placed on the covering panels.

The patents noted herein provide considerable information regarding the developments that have taken place in this field of protective covering technology. Clearly the instant invention provides many advantages over the prior art inventions noted above. Again it is noted that none of the prior art meets the objects of a rapidly deployable protective and STRUCTURAL COVER SYSTEM in a manner like that of the instant invention. None are as effective and as efficient as the instant rapidly deployable protective and structural cover system for completely covering and protecting an object or area, maintaining a controlled environment inside the protective covering and such that the outer sheeting may be removed for repair without disturbing the structure of the system.

SUMMARY OF THE INVENTION

This invention most fundamentally is a multilayer flexible cover made up of a flexible structural netting and a flexible sheeting attached each to the other at junctions of the horizontal and vertical netting members. Preferably the attachment is air-tight and is undoable so that new flexible sheeting may replace damaged portions of the flexible sheeting. The multilayer flexible cover is a protective and structural cover system primarily for use in building and repair industries such as ship building and repair, bridge work, building construction or repair to a building and for use where a low-cost system of protection of a structure or space is needed and needed quickly. More particularly, the invention relates to a rapidly deployable protective and structural cover system comprising a rigid support structure which may be a part of the structure being covered or protected or may be separately fabricated and attached to the structure to which is attached the multilayer flexible cover using either rigid members or cables attachable at the ends to the rigid support structure. Where cables are used there is also a means to tension the cables such as a tumbuckle. The multilayer flexible cover is removably attachable along edges of the structural netting portion to the cables. Springs may be use for absorbingly attaching another edge of the structural netting to the rigid support structure.

The basic objects and advantages of the invention are to provide a rapidly deployable protective and structural cover and cover system for completely covering and protecting an object or area, such that a controlled environment may be maintained inside the protective covering and such that the outer sheeting may be removed for repair without disturbing the structure of the system, and such that load is distributed throughout the system, and not just on the outer sheeting such that the covering is extremely durable and load and wind resistant.

The invention has the particular objectives, features and advantages of: 1) providing a multiple-use product which enables many contracts to be undertaken using the same covering system, i.e., when a project is completed the protective system is quickly removed and completely reusable at a new contract site resulting in substantial savings in that the system is very economical; 2) to be required to erect the containment or cover system for a particular project (building, bridge, ship, etc.) only once, thus eliminating expensive refitting and unnecessary delays due to conventionally having to recover the project if the covering is damaged or removed for any reason; 3) to provide quick and easy deployment of the cover system resulting in huge savings in set-up labor costs; 4) white, flexible protective sheeting is very advantageous in hot climates to control temperatures inside the containment whilst still allowing sufficient light transmission for work to be carried out; 5) in the event the flexible sheeting sustains damage, it is removed from the underlying attached structural netting and a new sheeting or a portion of a new sheet is refitted without altering any part of the structure of the system; 6) to provide tensioned cables at most preferably 6'3" centers to which is attachable with such as spring clips, the edges of the structural netting; 7) to provide netting manufactured so that the horizontal and the vertical members or strands of the netting intersect substantially at the location of the means for attaching the flexible sheeting to the structural netting, which means for attaching may be eyelets and anchors which attach through the eyelets to the netting at the intersections (eyelets may be the MONARFLEX brand of eyelet and the MONOSTUD brand of stud and cable ties); 8) to provide tension springs at the top or the bottom of the netting attached between the netting and the rigid frame system; 9) to provide sheeting attached at 3'1" centers over the surface of the sheeting; and 10) to provide jointing of overlap of sheeting, with MONOBOND brand of double-sided tape.

Yet another object is to provide a system which allows the sheeting to transfer any wind or snow loadings into the inner tensioned netting and thence into the cable system, instead of having the sheeting take the entire load.

These and further objects of the present invention will become apparent to those skilled in the art to which this invention pertains and after a study of the present disclosure of the invention.

DESCRIPTION OF THE PREFERRED EMBODIMENTS

The following is a description of the preferred embodiment of the invention. It is clear that there may be variations in the size and the shape of the system, in the materials used in the construction and in the orientation of the components.

Figure 1:
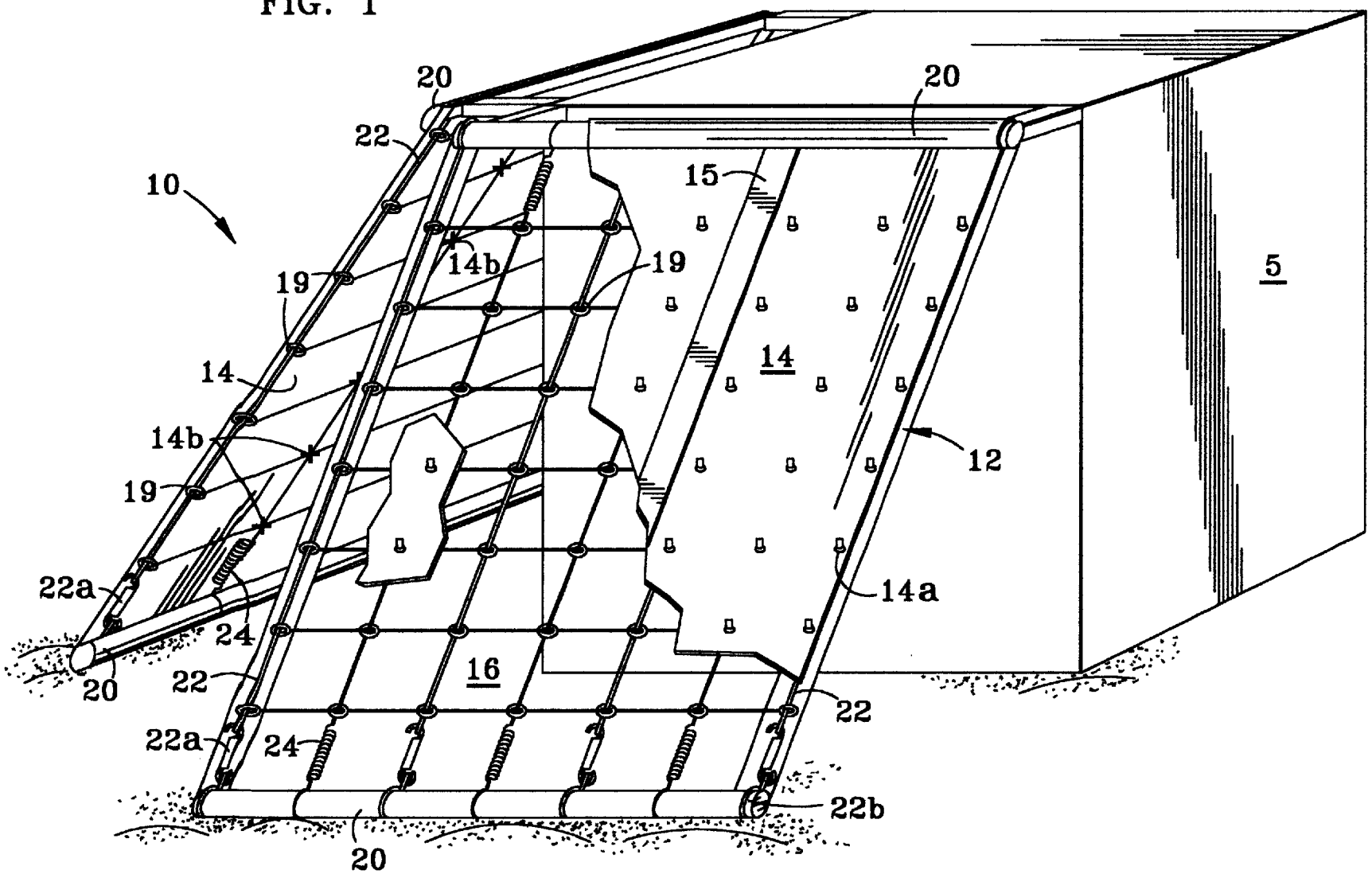
FIG. 1 is a pictorial sketch illustrating use of the cover system showing protection on two sides and showing a partially cut-away view to show cables, springs, turnbuckles, spring clips and the like, the cover system attached to a rigid frame system.

Reference is now made to the drawings. The drawings show simply the preferred embodiments of the system which have the following preferred specifications:

FIG. 1 is schematically illustrative of the manner of use of the cover system. A structure 5 is to be protected or partially protected. A rigid frame system made of frame members 20 is built which attaches, in this instance, at the top of structure 5 and on the ground along side of structure 5. A possible manner to deploy the cover system 10, is to attach cables 22 by means for attaching 22*b* the cable to frame members 20 at the top of structure 5. Multilayer flexible cover 12 is attached at the edges of flexible netting 16 and to cable 22 using, for example spring clips 19. Certainly any appropriate means for attaching is within the scope of this invention. Multilayer flexible cover 12, is comprised of flexible sheeting 14 which is attached to flexible structural netting 16 at intersections 16*c* of horizontal netting member 16*a* and vertical netting member 16*b*. It should be noted that the structural netting portion of the multilayer flexible cover need not have orthogonally directed strands or members and they need not intersect with each other only at locations which correspond to the points of attachment of the flexible sheeting to the flexible structural netting. Each netting member or strand may be made of, for example, rope, polypropylene, nylon, or other suitable strong material. In the disclosure of the preferred embodiment, the flexible sheeting 14 has eyelets 14*a* on 3 ft. 2 inch rectangular grid and these location of eyelets 14*a* corresponds to the location of intersections 16*c*. Devices for attaching sheeting 14 to netting 16 may be any appropriate clip or device 14*b* which permits periodic attachment of sheeting 14 to netting 16 at an intersection 16*c* of the netting members such as 16*a* and 16*b*.

Multilayer cover 12, as spring clips 19 are attached to cable 22, is lowered down the cables. Cable 22 are made taut using, for example, turnbuckles 22*a*. Additional cables 22 may be located between the cables located at the edges of netting 16 providing extra support. Springs 24 are attached at least at the top or the bottom edge of netting 16. The number of springs 24 that are used will depend upon the application and the forces and winds encountered. Additional covers 12 are likewise installed each adjacent to another. The edges of the flexible sheeting 14 may be connected using tape 15 or any other appropriate means for attaching the edges. Greater care is used to join or attach the edges when the structure or the area/volume must be sealed to the outside environment. Similarly, the top and the bottom of multilayer flexible cover 12 may require sealing so as to adequately enclose the volume within the cover system 10

Figure 2:
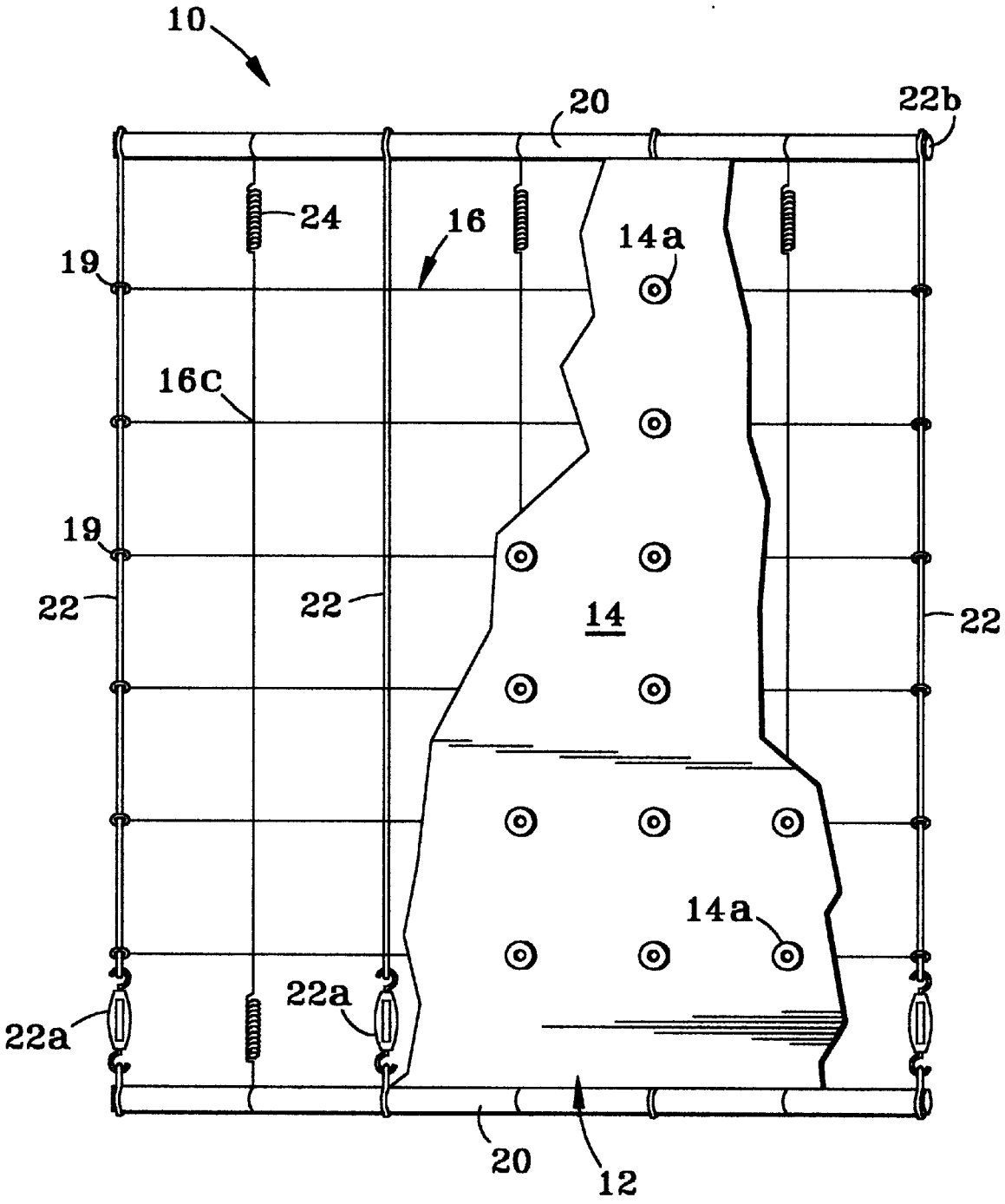
FIG. 2. is a pictorial sketch illustrating the multilayer flexible cover attached to the rigid frame system and to tensioned cables.

FIG. 2 shows a partially cut-away view of flexible sheeting 14 over netting 16 and further illustrating cables 22, spring clips 19 netting 16 attached to frame member 20 at the top and the bottom. The system 10 is shown wherein multilayer flexible cover 12 is structurally supported on a support frame comprised of tubular frame members and tensioned frame steel cables. The support frame could also be tubular frame members instead of tensioned steel cables. Cover 12 may also be clamped to a particular frame structure, or the frame could be, for example, a building or a portion of the building, ship or bridge already in place.

Figure 3:
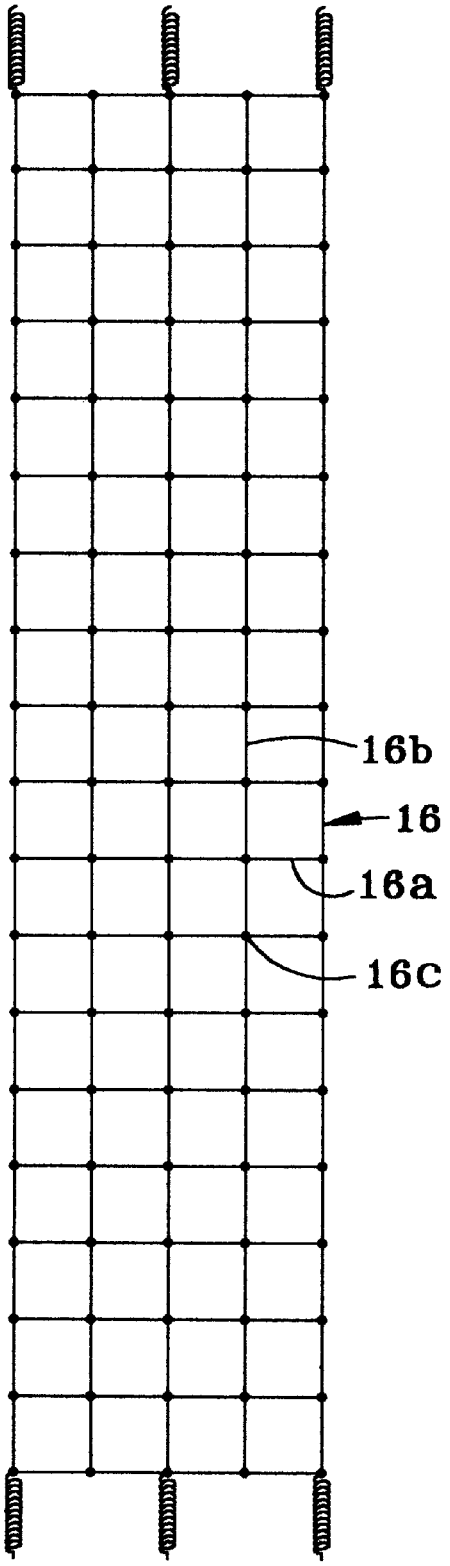
FIG. 3 is a sketch of the preferred structural netting dimensions which would be used with flexible sheeting having eyelets in a rectangular matrix array with 3 feet 1 inch spacing and sheeting width of 13 feet.

FIG. 3 is a sketch showing dimensions of netting 16 which when used with flexible sheeting 14 having a width of 13 feet and eyelets located on a square grid 37 inches by 37 inches, provides a multilayer flexible cover 12 which is reasonable in size for handling and ease of deployment. Certainly multilayer covers of any dimension is possible. It should also be clear that there need not be an intersection of netting element or strands only being located at an eyelet.

Most preferably MONARFLEX brand of universal sheeting 14 is disposed over structural netting 16 and attached to the structural netting by means of MONARFLEX brand of eyelets which are incorporated in the MONARFLEX brand of sheeting. The sheeting is attached using as attaching members MONOSTUDS brand of studs and cable ties, or by MONARFLEX "T" clamps or MONARFLEX polytoggles and wedges. The eyelets therefore do not contain an aperture until an attaching member is inserted through the eyelet thereby creating an aperture therethrough. The eyelets allow the sheeting to be attached to the netting at intersections of the netting members wherein the attaching member is inserted from the outside, through an eyelet, and attached to the netting material at an intersection of the netting material members. The "gauge" or size of the netting may vary, and may be such that there is one corresponding netting material intersection for every eyelet. However, the netting may also be of "finer gauge" such that intersections of netting material occur more frequently than the eyelets, but wherein even if there is not a netting material intersection which corresponds directly to a particular eyelet, that there would be an intersection near enough to an eyelet, by which the sheeting could be attached to the netting. Also, the netting may be of a "larger gauge" than the spacing of the eyelets such that there, for example, might only be one netting material intersection located at every other eyelet. This would not be a problem in creating any openings in the sheeting (at the unused eyelets) through which the elements could penetrate, because the eyelets do not contain an aperture until a MONOSTUD and cable tie or other attaching member has been inserted.

The combination of the frame structure of frame members and tensioned steel cable, and the structural netting of cable with tension springs allows load received on the outer sheeting to be distributed and dispersed across the underlying netting and frame structure. This allows the whole structure (except the framing members) to flex and thereby prevents excessive rippling or flapping of the outer sheeting which yields a more stable structure overall, and prolongs the life of the outer sheeting. When, as will likely happen anyway, the outer sheeting sustains damage, such as puncture by an object, and requires replacement, the damaged sheeting segment or panel may be removed and replaced without damaging adjacent panels or disrupting the underlying netting and framing structure of the system. Although the netting and sheeting may be preformed already attached for initial installation, they may also be formed separately such that the outer sheeting may be replaced alone.

This system not only allows for rapid deployment, longer life of the components—even to the extent of being reusable, and easy repair and replacement of damaged sections, it also provides a controlled internal environment for working. An object or area covered by the system can be completely isolated from the exterior environment, (except for entry areas for workers and equipment, or "breaches" in the material to allow for venting, exhausting or otherwise ventilating the enclosure) either to protect the interior area from the elements or to protect the environment from the activity occurring inside the system. Thus, the system may be heated, cooled, or ventilated to suit the needs of a particular project. The types of projects to which this system is ideally suited are projects such as a containment system for dry-dock, shipyard use, construction-site temporary shelters, exterior claddings, scaffold claddings, and other similar projects.

The interior of the enclosure formed by the system can be completely isolated from the outside environment, either to keep harmful environmental elements out of the enclosure, or to control temperature or humidity inside the enclosure, or to keep harmful material used in the enclosure from reaching the outside environment. The number sizes of the structures or enclosures made using the system is infinite—any size of rigid support frame may be made and any amount of netting and cover sheeting may be used. The structural integrity which the system offers will enable contractors and users to meet strict environmental and occupational regulations. The system will give total control of air pressure, air flow, and humidity together with structural integrity even at high winds and heavy loads. Such features enable contractors to work unhindered for long periods of time in a controlled environment to complete contracts on time and with a very high quality level of workmanship.

It is thought that the present rapidly deployable protective and structural cover system, and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A multilayer flexible cover comprising:

a flexible structural netting, said flexible structural netting having a plurality of first netting members and a plurality of second netting members, each said first netting members having an upper end and a lower end, each said first netting members and each said second netting members intersecting, said intersecting of each said first netting members and said second netting members creating thereby junctions; and a flexible sheeting removably attached to said flexible structural netting at a predetermined number of said junctions.

2. The multilayer flexible cover according to claim 1 wherein each of said junctions, are such that each said first netting members intersects substantially orthogonally with each said second netting members, creating thereby substantially right-angle junctions.

3. The multilayer flexible cover according to claim 1 further comprising means for making said flexible sheeting removably attachable to said flexible structural netting.

4. The multilayer flexible cover according to claim 1 further comprising means for pliably attaching at least one of said upper ends of said first netting members to a rigid upper frame member and a means for pliably attaching at least one of said lower ends of said first netting members to a rigid lower frame member of a support structure.

5. The multilayer flexible cover according to claim 4 further comprising means for slidingly attaching at least one end of each of said second netting members to a tensionable cable member, said cable member having one end connected to said rigid upper frame member and another end connected to said rigid lower frame member.

6. A rapidly deployable protective and structural cover system used to cover and protect a structure, comprising:

a support structure comprising a rigid upper frame member and a rigid lower frame member and a plurality of tensionable cable members each cable member having one end connected to said rigid upper frame member and another end connected to said rigid lower frame member, said support structure being attachable to said structure being covered and protected;

a flexible structural netting, said flexible structural netting having a plurality of first netting members and a plurality of second netting members, each said first netting members having an upper end and a lower end, each said second netting members having a first end and a second end thereof, each said first netting members and each said second netting members intersecting, said intersecting of each said first netting members and said second netting members creating thereby junctions and each said first end of said second netting member attachable to one of at least two of said tensionable cable members and each said second end of said second netting member attachable to a second of said at least two of said tensionable cable members; and a flexible sheeting attached to said flexible structural netting at a predetermined number of said junctions.

7. The rapidly deployable protective and structural cover system according to claim 6 wherein said rigid upper frame member and said rigid lower frame member are a part of said structure being covered and protected.

8. The rapidly deployable protective and structural cover system according to claim 6 wherein each of said junctions, are such that each said first netting members intersects substantially orthogonally with each said second netting members, creating thereby substantially right-angle junctions.

9. The rapidly deployable protective and structural cover system according to claim 6 further comprising means for making said flexible sheeting removably attachable to said flexible structural netting.

10. The rapidly deployable protective and structural cover system according to claim 6 further comprising means for pliably attaching at least one of said upper ends of said first netting members to said rigid upper frame member and means for pliably attaching at least one of said lower ends of said first netting members to said rigid lower frame member of said support structure.

11. The rapidly deployable protective and structural cover system according to claim 10 further comprising means for slidingly attaching at least one end of each of said second netting members to said tensionable cable member.

* * * * *